US009637935B2

(12) United States Patent
Chen

(10) Patent No.: US 9,637,935 B2
(45) Date of Patent: May 2, 2017

(54) SCRAPING DEVICE

(71) Applicant: Shou-Hung Chen, Taipei (TW)

(72) Inventor: Shou-Hung Chen, Taipei (TW)

( * ) Notice: Subject to any disclaimer, the term of this patent is extended or adjusted under 35 U.S.C. 154(b) by 12 days.

(21) Appl. No.: 14/607,078

(22) Filed: Jan. 28, 2015

(65) Prior Publication Data

US 2016/0262589 A1 Sep. 15, 2016

(51) Int. Cl.

*E04F 21/165* (2006.01)
*E04F 21/32* (2006.01)
*E04F 21/00* (2006.01)

(52) U.S. Cl.

CPC ..... *E04F 21/1652* (2013.01); *E04F 21/165* (2013.01); *E04F 21/1655* (2013.01); *E04F 21/32* (2013.01); *E04F 21/0084* (2013.01)

(58) Field of Classification Search

CPC ..... E04F 21/0084; E04F 21/16; E04F 21/161; E04F 21/162; E04F 21/163; E04F 21/165; E04F 21/1652; E04F 21/1655; E04F 21/28; E04F 21/32; B05C 17/10; A47L 13/02; A47L 13/022; A47L 13/08; B08B 1/005

USPC ..... 15/105, 105.5, 235.7, 235.8, 236.01, 15/236.05–236.09, 245.1; 30/169, 172; 425/458

See application file for complete search history.

(56) References Cited

U.S. PATENT DOCUMENTS 6,035,536 A * 3/2000 Dewberry ..... E04F 21/0084 15/235.7
7,908,702 B2 * 3/2011 Accumanno ..... E04F 21/32 15/105.5
2010/0162509 A1 * 7/2010 Liao ..... E04F 21/165 15/235.7

* cited by examiner

*Primary Examiner* — Mark Spisich
(74) *Attorney, Agent, or Firm* — Rosenberg, Klein & Lee

(57) ABSTRACT

A scraping device includes a first grip with a first scraping member connected thereto. A connection member is connected to the first scraping member. A second grip is pivotably connected to the first grip and has a second scraping member connected thereto. A spreading plate has multiple rounded corners, and a fixing hole is defined in the spreading plate. The connection member is connected to the fixing hole to connect the spreading plate to the first scraping member. A third scraping member is connected to the pivotal position between the first and second grips. The scraping device has multiple functions.

8 Claims, 10 Drawing Sheets

SCRAPING DEVICE

BACKGROUND OF THE INVENTION

1. Fields of the Invention

The present invention relates to a scraping device, and more particularly, to a scraping device with multiple scraping members to meet different working tasks.

2. Descriptions of Related Art

When installing glasses to windows or doors, sealant is used to seal the gaps/seams between the frame of the window/door and the glass. The sealant has to be smoothed and then removed along the edges of the glass. The conventional scrapping devices are designed to remove the sealant along the edges of the glass. This task typically involves cutting, scraping, and pulling the old sealant out of the seam, and subsequently applying new sealant to the seam. In some situations, there is sealant or glue left on the glass or the window/door, the scrapping device is used to remove it.

U.S. Pat. No. 7,908,702 discloses a caulk remover and smoother, however, the caulk remover and smoother has limited function and can only deal with limited problems. Therefore, the users may need to carry multiple tools to deal different situations.

The present invention intends to provide a scraping device to eliminate the shortcomings mentioned above.

SUMMARY OF THE INVENTION

The present invention relates to a scraping device and comprises a first part and a second part, wherein the first part has a first scraping member, a first grip and a connection member. The first scraping member is connected to the first end of the first grip, and the connection member is connected to the first scraping member. The second part has a second scraping member and a second grip, wherein the second scraping member is connected to the first end of the second grip, and the second end of the second grip is pivotably connected to the second end of the first grip. The spreading plate has a fixing hole with which the connection member is connected. The spreading plate has multiple rounded corners.

Preferably, the second scraping member has two stop plates located on two sides thereof.

Preferably, a third scraping member is connected to the second end of the first grip. The second end of the second grip has a recess in which the third scraping member is located.

Preferably, the second grip has an opening, and a cutter is connected to the underside of the second grip and located corresponding to the opening.

Preferably, two pivots respectively extend from two sides of the second end of the first grip. The second end of the second grip has two holes. The two pivots are engaged with the two holes.

Preferably, the second end of the first grip has a rib extending from the underside thereof. The second end of the second grip has a groove defined in the underside thereof. The rib is engaged with the groove.

Preferably, the spreading plate is a silicon plate or a rubber plate. The rounded corners have different radiuses Preferably, the first scraping member has a flat front edge, and the second and third scraping members each have an arrow-head shaped front end.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
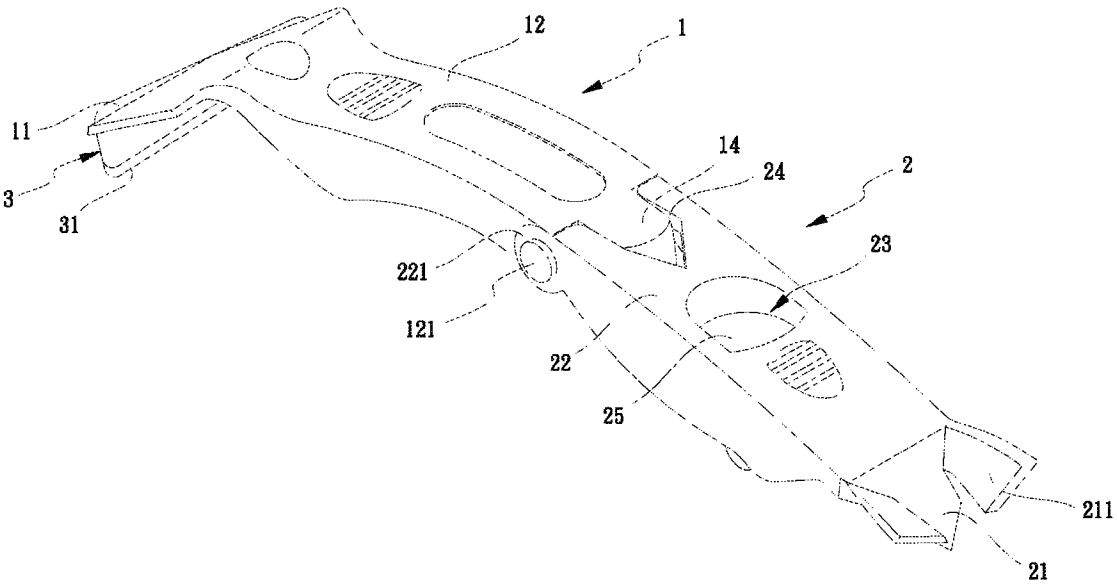
FIG. 1 is a perspective view to show the scraping device of the present invention.
Figure 2:
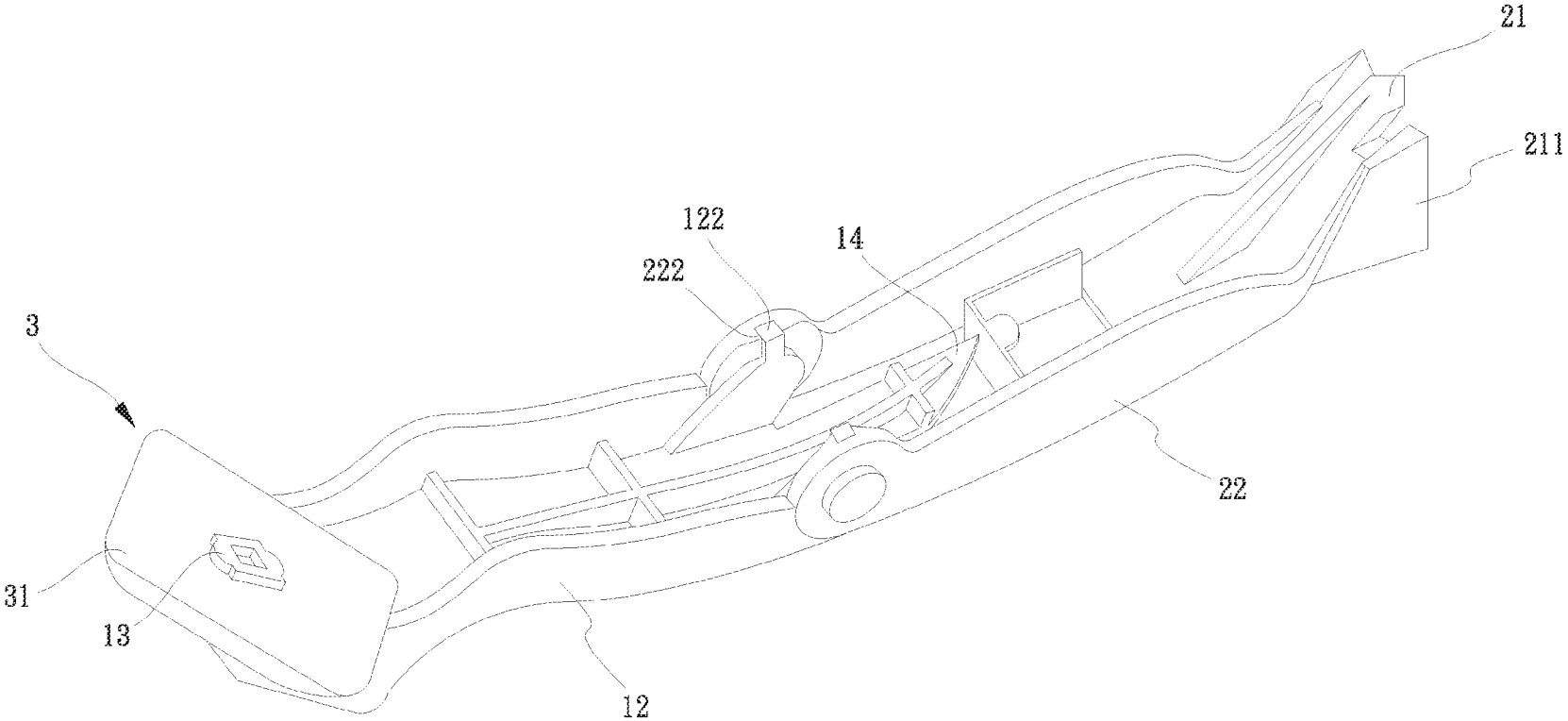
FIG. 2 is another perspective view to show the scraping device of the present invention.
Figures 3, 4:
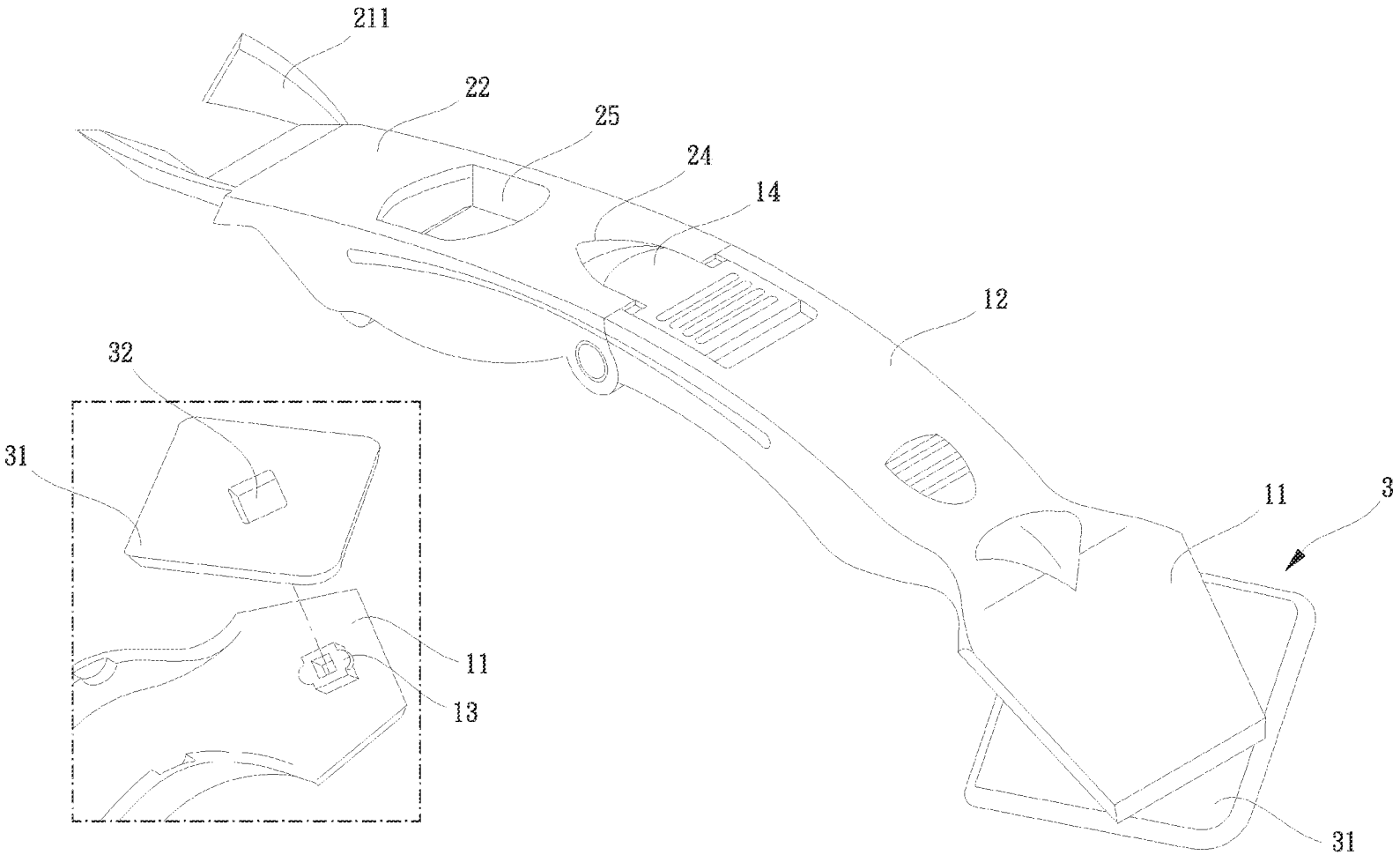
FIG. 3 is yet another perspective view to show the scraping device of the present invention.
FIG. 4 shows the spreading plate is to be connected to the first scraping member of the scraping device of the present invention.
Figure 5:
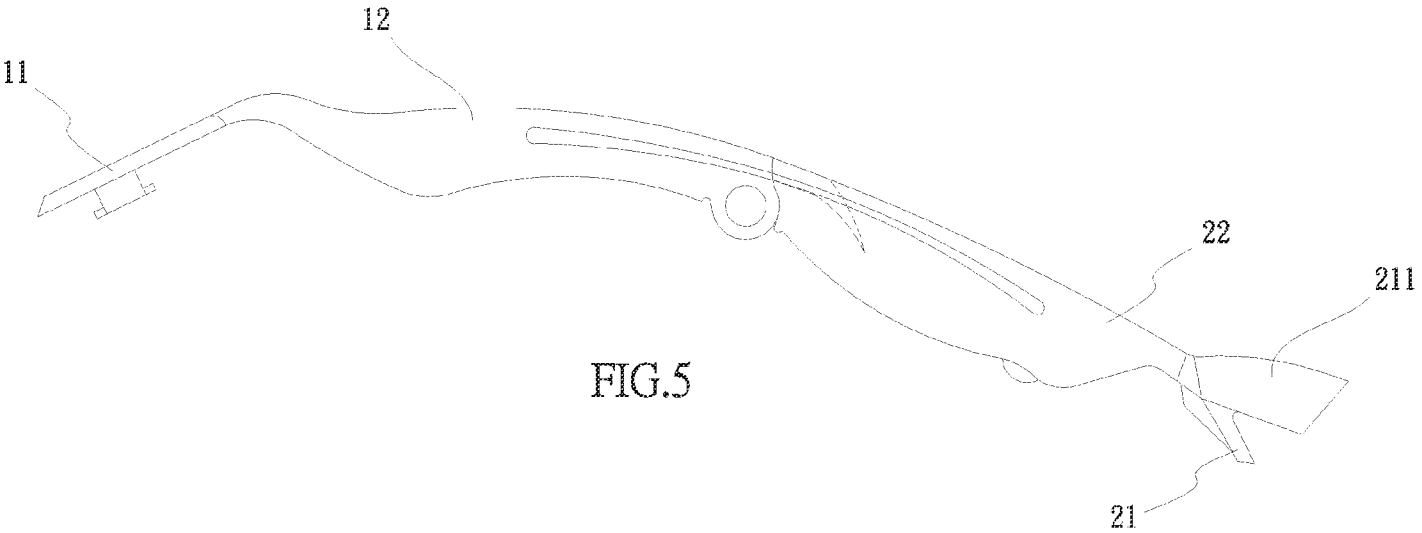
FIG. 5 is a side view of the scraping device of the present invention, wherein the spreading plate is not yet connected to the first scraping member.

Referring to FIGS. 1 to 8, the scraping device of the present invention comprises a first part and 1 a second part 2, wherein the first part 1 has a first scraping member 11, a first grip 12 and a connection member 13, and the second part 2 has a second scraping member 21 and a second grip 22. The first scraping member 11 is connected to the first end of the first grip 12, and the connection member 13 is connected to the first scraping member 11. The second scraping member 21 is connected to the first end of the second grip 22, and the second end of the second grip 22 is pivotably connected to the second end of the first grip 12. The spreading plate 3 has a fixing hole 32 with which the connection member 13 is connected such that the spreading plate 3 is connected to the first scraping member 11 as shown in FIGS. 1-4. The connection member 13 has two protrusions (FIG. 4) on two opposite sides thereof to more securely connect the spreading plate 3 to the first scraping member 11. The spreading plate 3 is a silicon plate or a rubber plate, and has multiple rounded corners. The rounded corners 31 have different radiuses.

Figure 6:
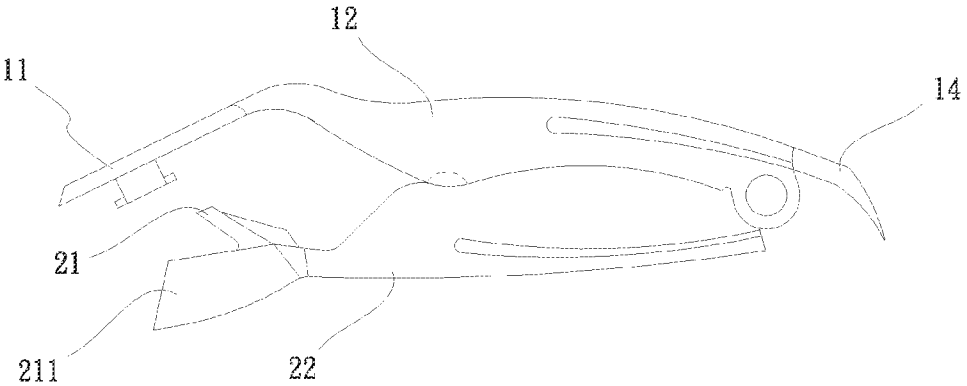
FIG. 6 is a side view to show the first part and the second part of the scraping device of the present invention in FIG. 5 are folded toward each other.
Figure 7:
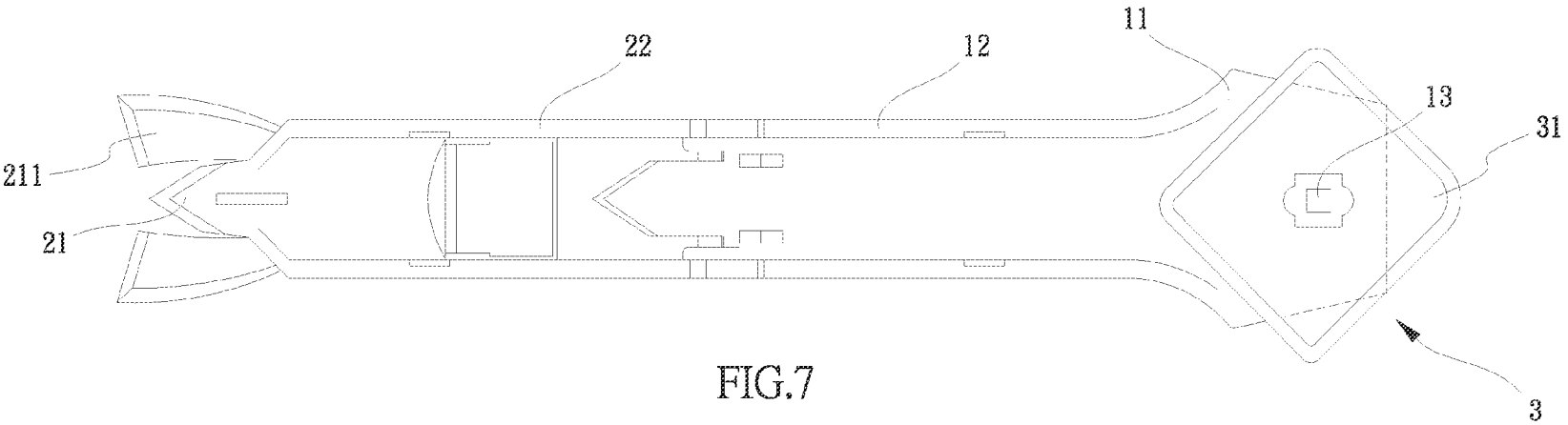
FIG. 7 is a top view to show the scraping device of the present invention wherein the spreading plate is connected to the first scraping member.
Figure 8:
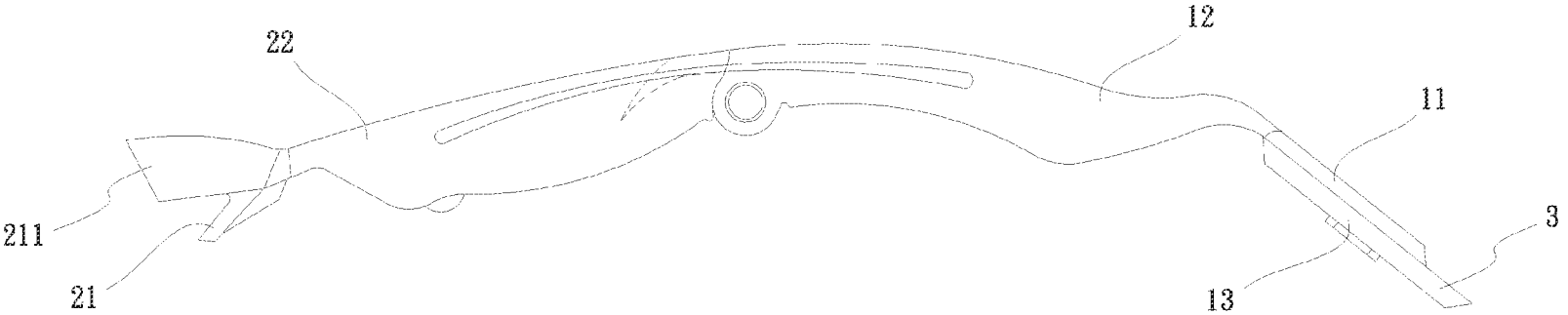
FIG. 8 is a side view to show the scraping device of the present invention wherein the spreading plate is connected to the first scraping member.

Two pivots 121 respectively extend from two sides of the second end of the first grip 12. The second end of the second grip 22 has two holes 221. The two pivots 121 are engaged with the two holes 221 so as to pivotably connect the first grip 12 to the second grip 22. In other words, the first and second grips 12, 22 can be folded toward each other to reduce its size so as to easily carry as shown in FIG. 6. The first and second grips 12, 22 each have a curvature which makes the user to hold then comfortably.

Figure 9:
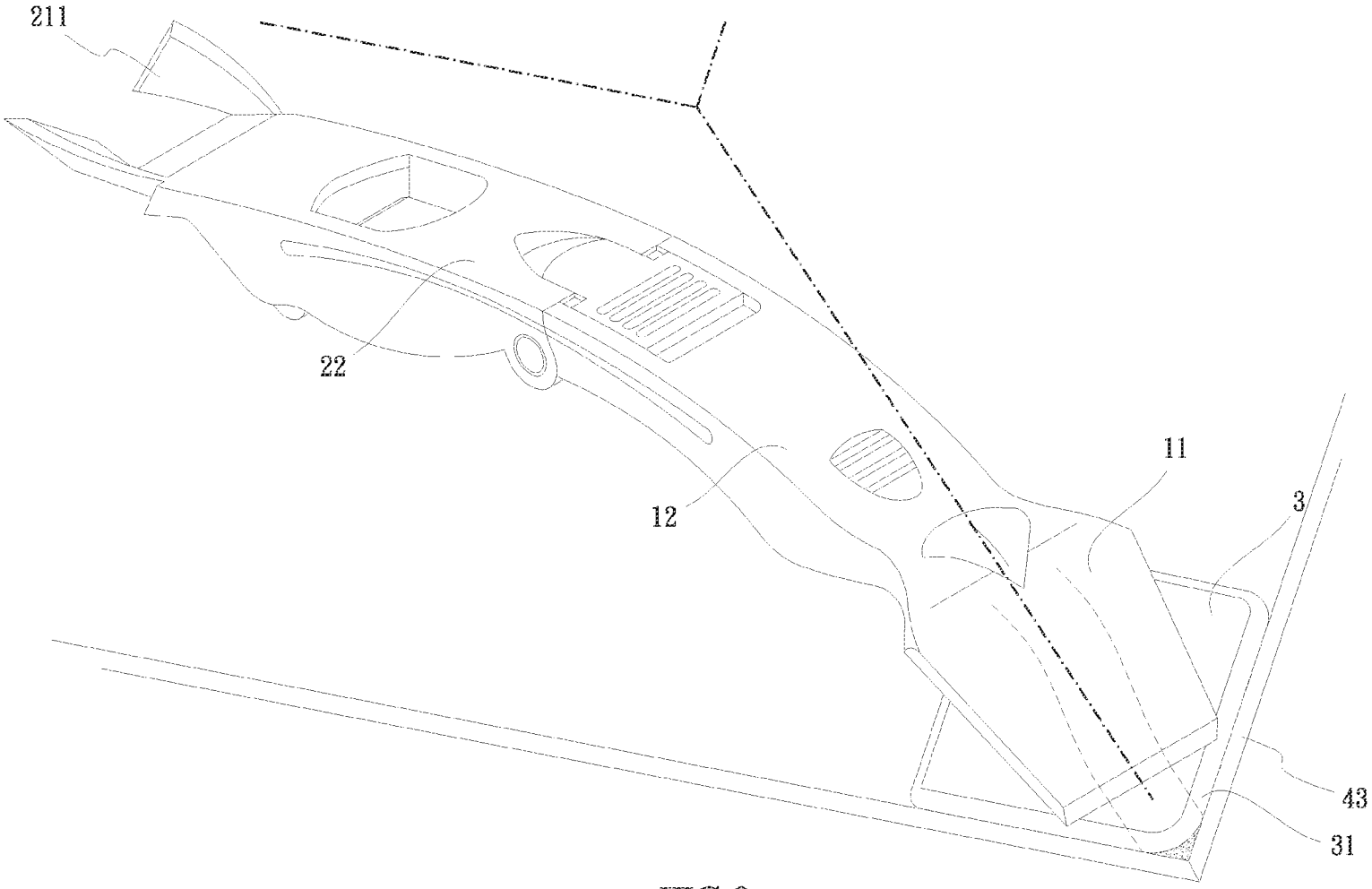
FIG. 9 shows that the spreading plate is used to press and trim the sealant at a corner.
Figure 10:
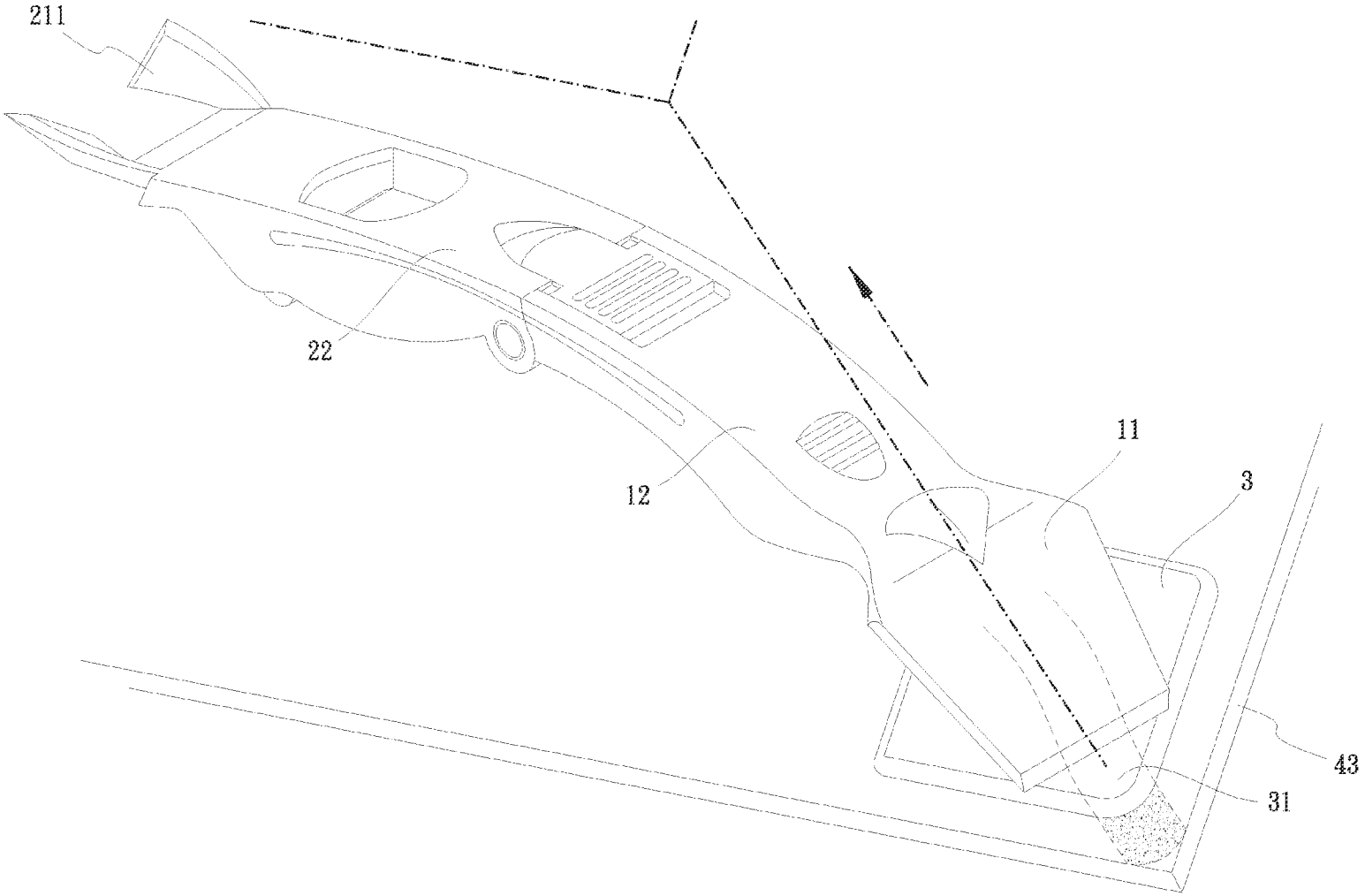
FIG. 10 shows that the spreading plate is used to spread the sealant from a corner.

As shown in FIGS. 9 and 10, the spreading plate 3 is connected to the first scraping member 11 by the connecting the connection member 13 to the fixing hole 32, so that the user can rotate the spreading plate 3 relative to the connection member 13 to use the desired rounded corner 31 to deal with the sealant 43.

Figure 12:
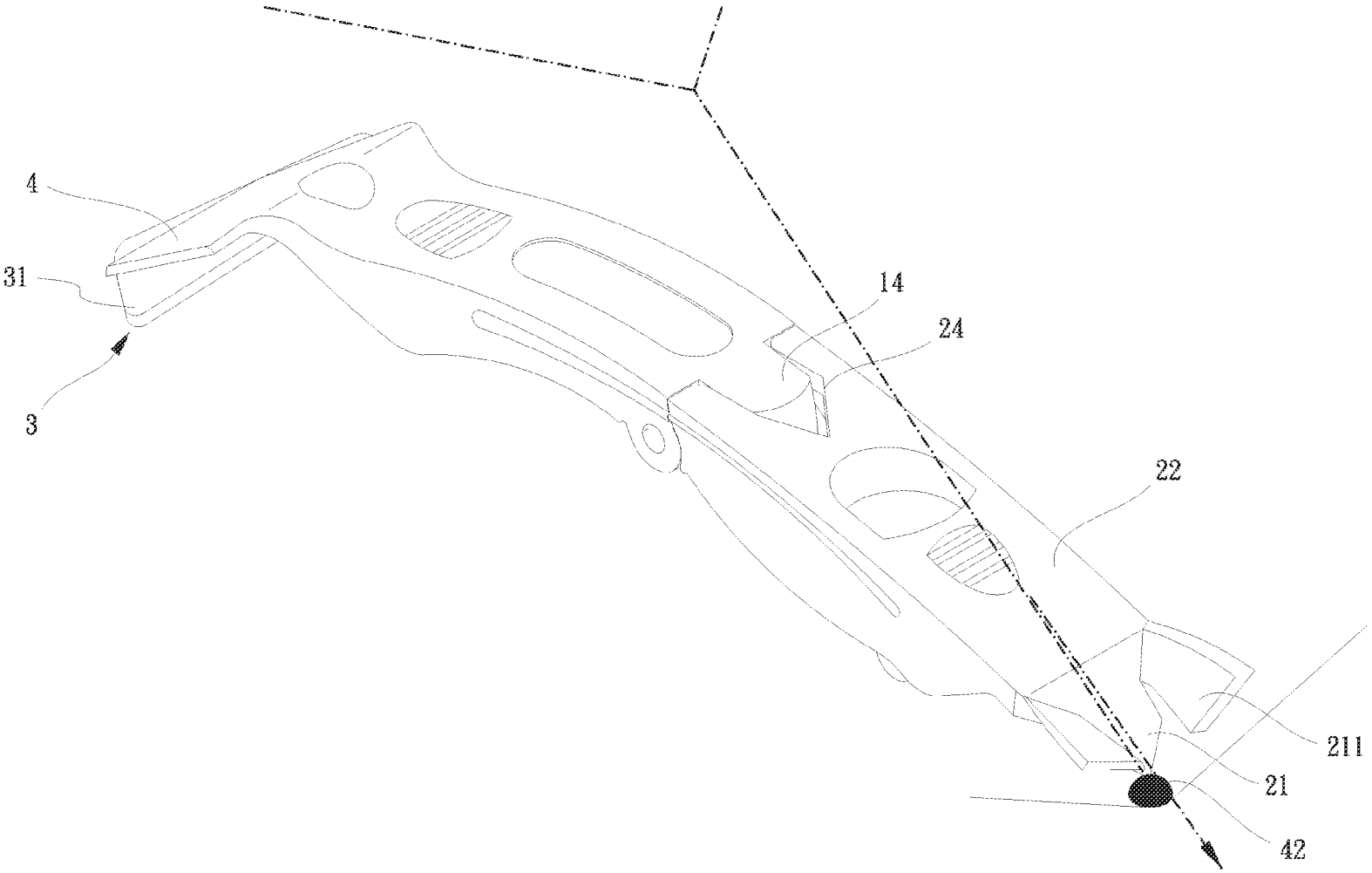
FIG. 12 shows the use of the second scraping member of the scraping device of the present invention.

In order to remove or spread the sealant 42 at the right corner, as shown in FIG. 12, the second scraping member 21 has two stop plates 211 located on two sides thereof. The two stop plates 211 are located at a right angle so that the two stop plates 211 contact against the two sides of the corner of the window/door, and the second scraping member 21 located between the two stop plates 211 can spread or remove the sealant 42.

Figure 13:
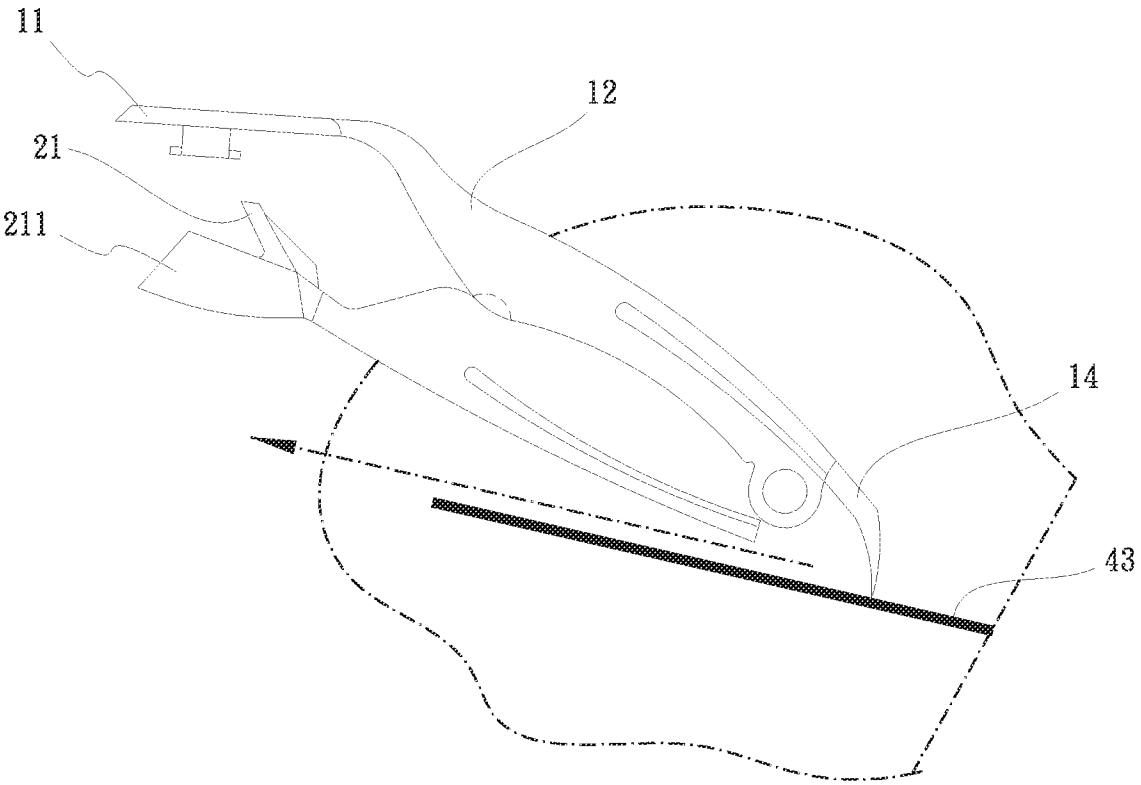
FIG. 13 shows the use of the third scraping member of the scraping device of the present invention.

Furthermore, a third scraping member 14 is connected to the second end of the first grip 12. The second end of the second grip 22 has a recess 24 in which the third scraping member 14 is located. Therefore, when the first and second grips 12, 22 are folded toward each other, as shown in FIG. 13, the third scraping member 14 is exposed from the recess 24 and can be used to remove sealant 43.

The second grip 22 has an opening 23, and a cutter 25 is connected to the underside of the second grip 22 and located corresponding to the opening 23. The cutter 25 is used to cut the sealant tube. In other words, the user does not need to purchase and carry an individual cutter.

The second end of the first grip 12 has a rib 122 extending from the underside thereof. The second end of the second grip 22 has a groove 222 defined in the underside thereof. When the first and second grips 12, 22 are pivoted and expanded, the rib 122 is engaged with the groove 222 to secure the expanded position of the first and second grips 12, 22.

Figure 11:
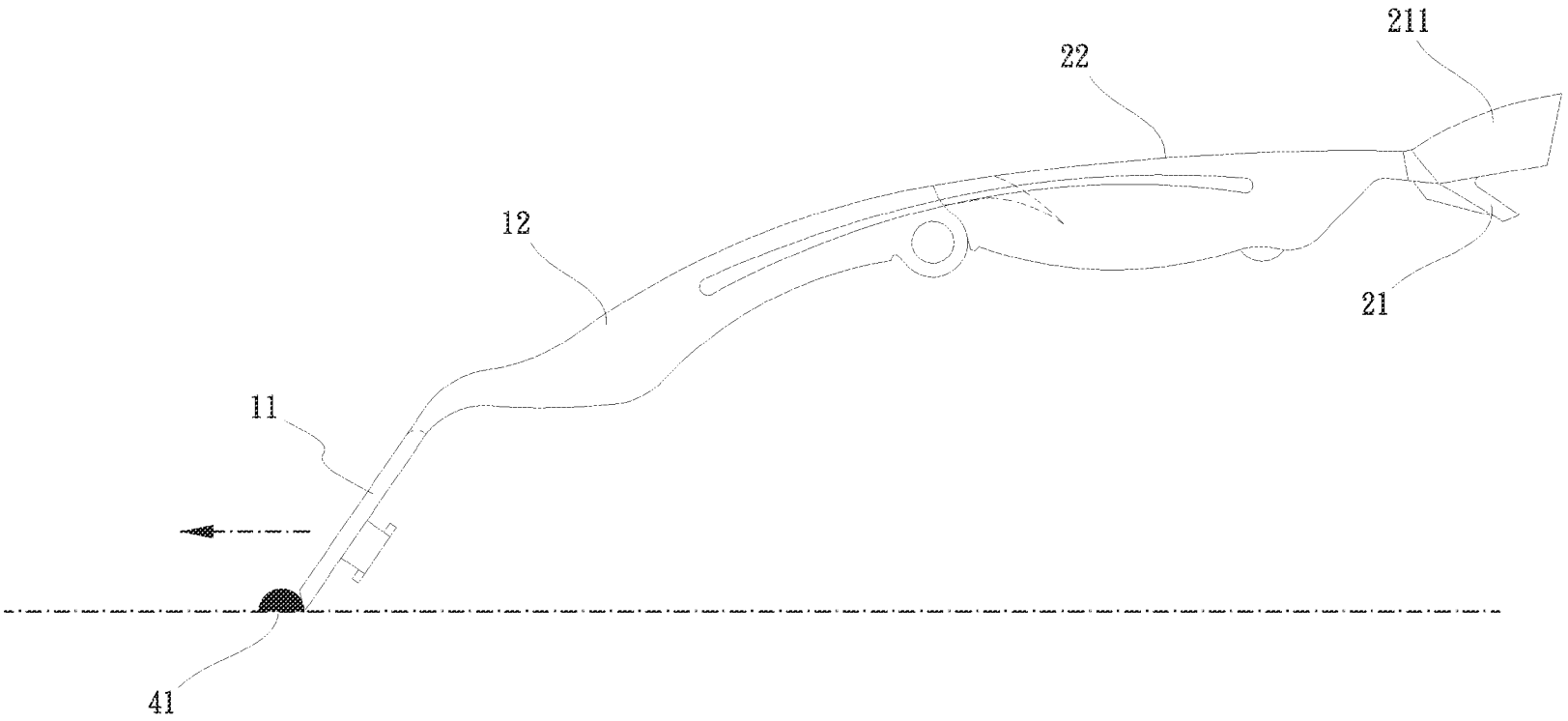
FIG. 11 shows the use of the first scraping member of the scraping device of the present invention.

As shown in FIG. 11, the first scraping member 11 has a flat front edge, and the second and third scraping members 21, 14 each have an arrow-head shaped front end. When removing a large area of sealant 41, the first scraping member 11 is used to remove the sealant 41 efficiently. As shown in FIG. 12, when the sealant 42 is located in a corner, the second scraping member 21 cooperated with the two stop plates 211 are used to easily remove the sealant 42 in the corner. As shown in FIG. 13, when the sealant 43 is located in a seam or a narrow area, the third scraping member 14 has a smaller arrow-head shaped front end which is used to easily remove the sealant 43.

The present invention can deal with different work tasks and the spreading plate 3 can be easily attached to the first scraping member 11. The first and second grips 12, 22 are able to be folded so that the present invention can be easily carried.

While we have shown and described the embodiment in accordance with the present invention, it should be clear to those skilled in the art that further embodiments may be made without departing from the scope of the present invention.

What is claimed is:

1. A scraping device comprising:

a first part (1) having a first scraping member (11), a first grip (12) and a connection member (13), the first scraping member (11) connected to a first end of the first grip (12), the connection member (13) connected to the first scraping member (11);

a second part (2) having a second scraping member (21) and a second grip (22), the second scraping member (21) connected to a first end of the second grip (22), a second end of the second grip (22) pivotably connected to a second end of the first grip (12); and a spreading plate (3) having multiple rounded corners (31), the spreading plate (3) having a fixing hole (32) with which the connection member (13) is connected.

2. The scraping device as claimed in claim 1, wherein the second scraping member (21) has two stop plates (211) located on two sides thereof.

3. The scraping device as claimed in claim 2, wherein a third scraping member (14) is connected to the second end of the first grip (12), the second end of the second grip (22) has a recess (24) in which the third scraping member (14) is located.

4. The scraping device as claimed in claim 3, wherein the second grip (22) has an opening (23), a cutter (25) is connected to an underside of the second grip (22) and located corresponding to the opening (23).

5. The scraping device as claimed in claim 4, wherein two pivots (121) respectively extend from two sides of the second end of the first grip (12), the second end of the second grip (22) has two holes (221), the two pivots (121) are engaged with the two holes (221).

6. The scraping device as claimed in claim 5, wherein the second end of the first grip (12) has a rib (122) extending from an underside thereof, the second end of the second grip (22) has a groove (222) defined in the underside thereof, the rib (122) is engaged with the groove (222).

7. The scraping device as claimed in claim 3, wherein the first scraping member (11) has a flat front edge, the second and third scraping members (21, 14) each have an arrow-head shaped front end.

8. The scraping device as claimed in claim 1, wherein the spreading plate (3) is a silicon plate or a rubber plate, the rounded corners (31) have different radiuses.

* * * * *